US008727040B2

(12) United States Patent
Schroeder et al.

(10) Patent No.: US 8,727,040 B2
(45) Date of Patent: May 20, 2014

(54) DRILL STRING VALVE AND METHOD

(75) Inventors: Derryl Schroeder, College Station, TX (US); Michael Friedrichs, Montgomery, TX (US)

(73) Assignee: Hydril USA Distribution LLC, Houston, TX (US)

( * ) Notice: Subject to any disclaimer, the term of this patent is extended or adjusted under 35 U.S.C. 154(b) by 558 days.

(21) Appl. No.: 12/915,114

(22) Filed: Oct. 29, 2010

(65) Prior Publication Data

US 2012/0103619 A1 May 3, 2012

(51) Int. Cl.
*E21B 23/10* (2006.01)

(52) U.S. Cl.
USPC ..... 175/232; 175/317

(58) Field of Classification Search
USPC ..... 166/332.2, 316; 175/57, 232, 317, 318
See application file for complete search history.

(56) References Cited

U.S. PATENT DOCUMENTS

| | | | | |
|---|---|---|---|---|
| 3,967,679 | A * | 7/1976 | Liljestrand | 166/317 |
| 6,732,819 | B2 * | 5/2004 | Wenzel | 175/218 |
| 2004/0112641 | A1 * | 6/2004 | Chan et al. | 175/57 |

* cited by examiner

*Primary Examiner* — Brad Harcourt
(74) *Attorney, Agent, or Firm* — Bracewell & Giuliani LLP

(57) ABSTRACT

Method and drill string valve assembly for closing a conduit through which a high pressure fluid flows. The drill string valve assembly includes first, second and third portions forming an elongated housing having an inside cavity; and a drill string valve provided inside the cavity, to extend from the first portion to the third portion. The second portion has an extension that fits inside a groove of the third portion and prevents the second portion to linearly move relative to the third portion and also allows the second portion to rotate relative to the third portion, and the second portion has a distal region provided with a thread configured to engage a corresponding thread of the first portion such that a rotation of the second portion relative to the third portion determines a tight connection between the first portion and the second portion.

14 Claims, 13 Drawing Sheets

DRILL STRING VALVE AND METHOD

BACKGROUND

1. Technical Field

Embodiments of the subject matter disclosed herein generally relate to methods and valves and, more particularly, to mechanisms and techniques for interrupting a flow of liquid through a valve.

2. Discussion of the Background

During the past years, with the increase in price of fossil fuels, the interest in developing new oil production fields has dramatically increased. However, the availability of land-based production fields is limited. Thus, the industry has now extended drilling to offshore locations, which hold a vast amount of oil reserves. One characteristic of the offshore locations is the high pressure to which the drilling equipment is subjected. It is conventional to have parts of the drilling equipment designed to withstand pressures up to 30,000 psi. In addition, the materials used for the various components of the drilling equipment are desired to be corrosion resistant and to resist high temperatures.

Existing technologies for extracting oil from offshore fields use a system 10 as shown in FIG. 1. More specifically, the system 10 includes a drilling vessel 12 having a reel 14 that supplies power/communication cables 16 to a controller 18. The controller 18 is disposed undersea, close to or on the seabed 20. In this respect, it is noted that the elements shown in FIG. 1 are not drawn to scale and no dimensions should be inferred from FIG. 1.

FIG. 1 also shows that the drill string 24 is provided inside a riser 40, that extends from drilling vessel 12 to a BOP 28. A wellhead 22 of the subsea well is connected to a casing 44, which is configured to accommodate the drill string 24 that enters the subsea well. At the end of the drill string 24 there is a drill bit (not shown). Various mechanisms, also not shown, are employed to rotate the drill string 24, and implicitly the drill bit, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to as a "kick" or a "blowout" and may occur when formation pressure inside the well exceeds the pressure applied to it by the column of drilling fluid (mud). This event is unforeseeable and, if no measures are taken to prevent it, the well and/or the associated equipment may be damaged. Although the above discussion was directed to subsea oil exploration, the same is true for land oil exploration.

Thus, a blowout preventer (BOP) might be installed on top of the well to seal the well in case that one of the above events is threatening the integrity of the well. The BOP is conventionally implemented as a valve to prevent the release of pressure either in the annular space, i.e., between the casing and the drill pipe, or in the open hole (i.e., hole with no drill pipe) during drilling or completion operations. Recently, a plurality of BOPs are installed on top of the well for various reasons. FIG. 1 shows two BOPs 26 and 28 that are controlled by the controller 18.

However, ultra-deep water exploration presents a host of other drilling problems, such as substantial lost circulation zones, well control incidents, shallow-water flows, etc. Thus, many of these wells are lost due to significant mechanical drilling problems. These events increase the cost of drilling and reduce the chances that oil would be extracted from those wells.

A new technology for deep water exploration, which is discussed with regard to FIG. 2, has been developed in response to these problems. While the traditional technology uses single-gradient drilling, the new technology uses dual-gradient drilling for better controlling a bottom hole pressure, i.e., the pressure at the region around the drill bit 30 shown in FIG. 2. With the single gradient drilling, the bottom hole pressure is controlled by a mud (dedicated mixture of liquids used in the oil extraction industry) column extending from the bottom of the well 32 to the drilling vessel 12, as shown in FIG. 2. However, with the dual gradient drilling, a better pressure control is achieved through a combination of (i) mud from the bottom of the well 32 to a mud lift pump 34 and (ii) mud from the mud lift pump 34 to the drilling vessel 12. FIG. 2 shows that the new technology employs a mud return line 36 and a seawater power line 38 to the mud lift pump 34 beside the riser 40. The mud is provided through the drill string 24 to the drill bit 30. A subsea rotating device 42 is provided close to the BOP 26 to maintain separation between the sea water in the riser above the subsea rotating device 42 and the mud returns below. Thus, the dual gradient drilling system shown in FIG. 2 provides the mud pumped through the drill string 24 to the drill bit 30 and then pumped back up an annulus between the drill string 24 and the casing 44 by the mud lift pump 34.

The system shown in FIG. 2, which needs to balance the different pressures between the mud and the seawater when the mud lift pump 34 is not active, may employ a drill string valve 46 as shown in FIG. 3, which is disposed below the BOP 26 and close to the drill bit 30. Valve 46 may be required to restrain mud pressures up to 5,000 psi. The unbalanced pressure formed because of the U-tube effect of the mud could reach 5,000 psi, depending on the mud weight and water depth. This is a large pressure that would normally destroy valves used in faucets, irrigation systems, blood dialysis and other technical fields that use traditional valves. Due to these large pressures and the erosion problems posed by the salt-water and mud, one skilled in the art would not look or import components from valves used in these other technical fields because these valves are not designed to withstand large undersea pressures and corrosive environments. Also, the sealing requirements for the drilling industry make those valves used in the low pressure fields inappropriate for the drilling industry.

The conventional drill string valve 46 is placed inside the casing 44, close to the drill bit 30. Thus, the drill string valve 46 is a downhole tool and this valve is illustrated in FIG. 3. The drill string valve 46 has a sliding valve 50 that is configured to seal a passage 52 from a passage 54 inside spring carrier 48. The sliding valve 50 achieves the sealing in concert with cone seal 56. Cone seal 56 may be made of a strong metal and fixed relative to the drill string valve 46. The sliding valve 50 is movable along an axis Z and is biased by a spring 58. The sliding valve 50 is closed in a default position. When the mud is pumped from the vessel 12 towards the drill bit 30 (along axis Z in FIG. 2), the high pressure of the mud opens up the sliding valve 50 and compresses long coil spring 58. When the pumping from drilling vessel 12 stops, the compressed spring 58 closes the sliding valve 50.

A few disadvantages of the drill string valve 46 shown in FIG. 3 are now discussed. A drill collar of the valve was designed in two sections. The two sections include a lower long collar 62 to house the long coil spring 58 and a short upper collar 64 to house the valve mechanism. This design requires machining drill collars to high-precision, making holding diameters and concentricities, especially in deep bores, a challenge. Because it is a two-piece collar, assembly and disassembly requires the use of heavy "tongs" or "iron roughneck" to make up and break the drill collar connection. This equipment is not available in the shop and must be made up and broken on the drill floor.

A spring package includes the long coil spring 58, or tandem springs that make up a long spring, and are installed in a spring chamber 66. Buckling of the long springs 58 has been observed. The buckling increase a friction between the springs and the package as the coils contact with an outer diameter and an inner diameter of the spring chamber 66. Also, the spring package is open to borehole fluids in this design. Even if the spring area is packed in grease, the grease eventually is replaced with mud during drilling.

Another disadvantage of the system shown in FIG. 3 is related to the way in which the drill string valve 46 is assembled. The long coil spring 58 and spring carrier 48 are installed in the lower collar 62, where the spring carrier 48 male thread is screwed into a mating thread 63 at the lower end of the collar. Once installed, the spring carrier 48 is extended out of the top of the lower collar 62. The spring extension beyond the collar depends on the spring used, but could be up to 12 inches. This extreme condition would have the free length of the spring hanging out 3 inches beyond the spring carrier 48 with no support. The challenge is to handle the heavy upper collar 64, swallowing an unsupported spring end and having to compress the spring while lining up for engagement with the lower collar thread 65. The spring induced end load during these maneuvers could reach a few thousand pounds at thread engagement. This is a safety concern for the rig operator because of potential injury to the crew.

Accordingly, it would be desirable to provide systems and methods that avoid the afore-described problems and drawbacks.

SUMMARY

According to one exemplary embodiment, there is a drill string valve assembly that includes first, second and third portions forming an elongated housing having an inside cavity, the elongated housing extending along an axis and having a substantially constant outer diameter; and a drill string valve provided inside the cavity, to extend from the first portion to the third portion. The second portion has an extension that fits inside a groove of the third portion and prevents the second portion to linearly move relative to the third portion and also allows the second portion to rotate relative to the third portion, and the second portion has a distal region provided with a thread configured to engage a corresponding thread of the first portion such that a rotation of the second portion relative to the third portion determines a tight connection between the first portion and the second portion.

According to another exemplary embodiment, there is a drill string valve assembly that includes first portion, second portion and third portion forming an elongated housing having an inside cavity, the elongated housing extending along an axis and having a substantially constant outer diameter; a drill string valve provided inside the cavity, to extend from the first portion to the third portion; and at least one of a displacement sensor configured to determine a linear displacement of a spring provided inside the drill string valve and a load transducer configured to determine a spring compression existing in the spring. The second portion has an extension that fits inside a groove of the third portion and prevents the second portion to linearly move relative to the third portion and also allows the second portion to rotate relative to the third portion, and the second portion has a distal region provided with a thread configured to engage a corresponding thread of the first portion such that a rotation of the second portion relative to the third portion determines a tight connection between the first portion and the second portion.

According to still another exemplary embodiment, there is a method for assembling a drill string valve assembly. The method includes a step of providing first, second and third portions to be connected to each other; attaching a drill string valve to the third portion; rotating the second portion to the third portion such that an extension of the second portion fits into a groove of the third portion; and threading a portion of the second portion with a corresponding portion of the first portion so that the drill string valve is sealed inside the first, second and third portions.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a drill string valve that is provided offshore. However, the embodiments to be discussed next are not limited to this type of valve, but may be applied to other systems that are configured to interrupt a fluid flow.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a novel drill string valve has a substantially constant outer diameter, includes a loading mechanism for loading a valve spring of a spring package, the valve spring includes a wave spring, the spring package is immersed in an oil filled chamber and the oil filled chamber pressure is compensated from an annulus pressure. The above noted features are discussed next in more details. It is noted that the following exemplary embodiments may include one or more of these features or other features and no exemplary embodiment should be construed to require all these features or a specific combination of the features noted above.

Figure 4:
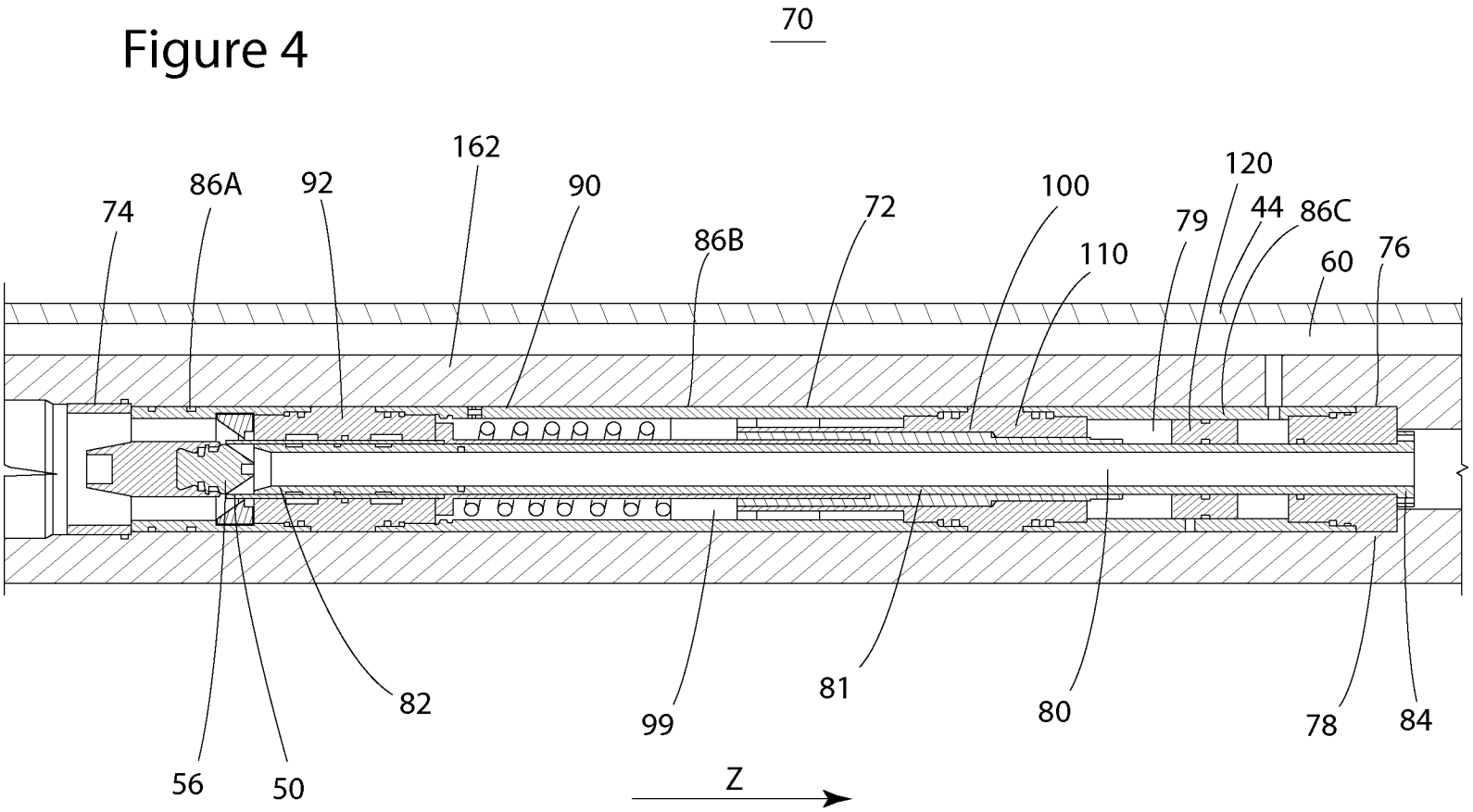
FIG. 4 is a schematic diagram of a novel drill string valve according to an exemplary embodiment.

According to an exemplary embodiment, FIG. 4 shows an overall view of a novel drill string valve 70. As shown in FIG. 4, an outer diameter 72 of the drill string valve 70 has a substantially constant value along an entire length of the drill string valve 70. The drill string valve 70 has a cone seal 56 attached to a first end 74 of the drill string valve 70. The cone seal 56 cooperates with a sliding valve 50 for shutting down a liquid flow through the drill string valve 70.

Figure 1:
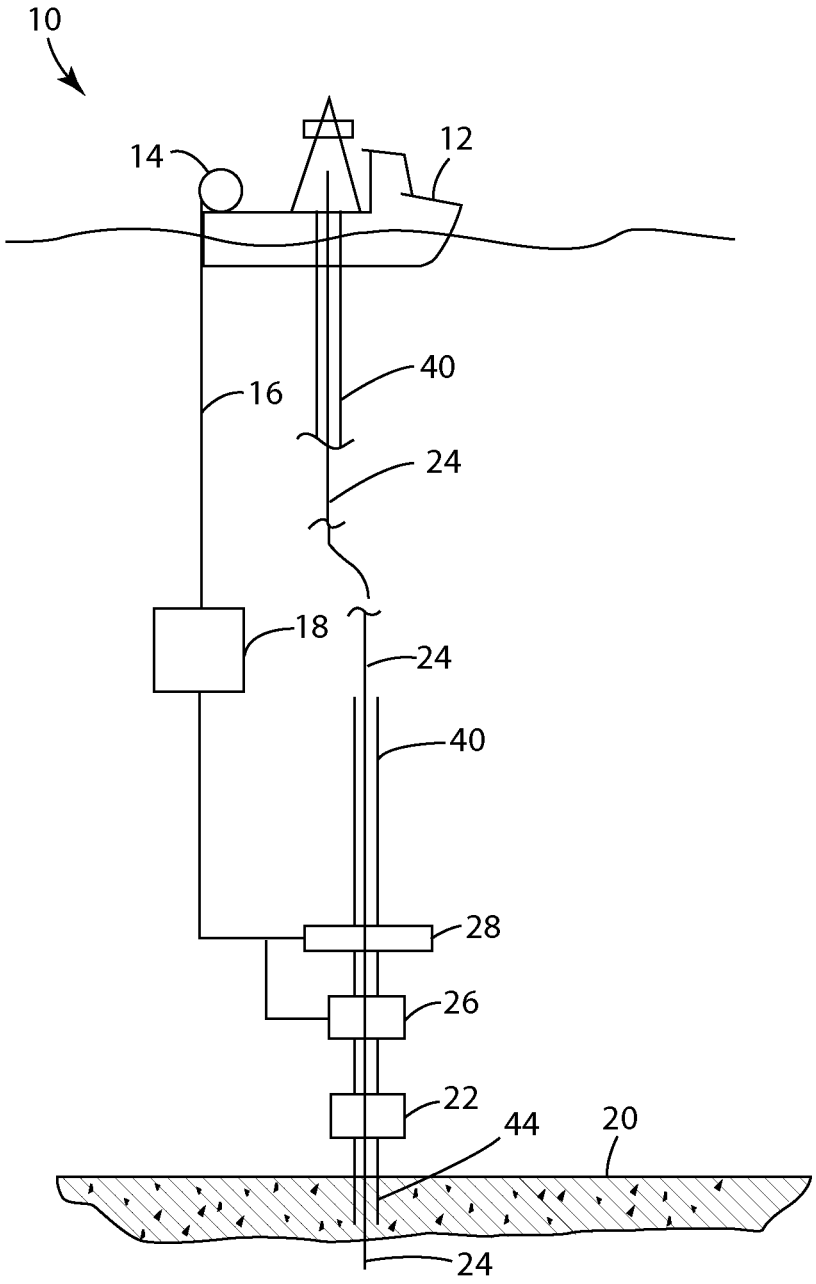
Figure 1 Background Art
FIG. 1 is a schematic diagram of a conventional offshore rig.
Figure 2:
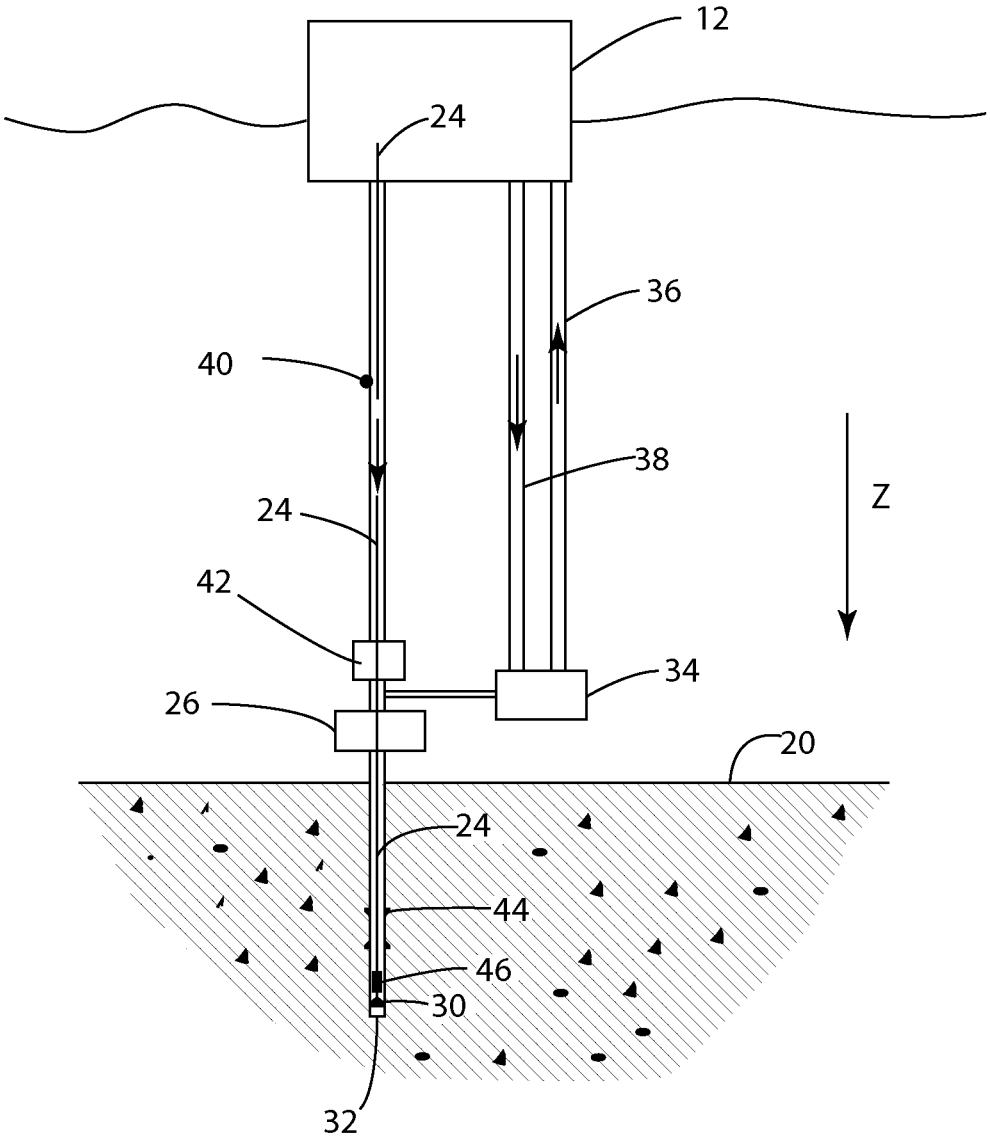
Figure 2 Background Art
FIG. 2 is a schematic diagram of a conventional dual-gradient drilling system.
Figure 3:
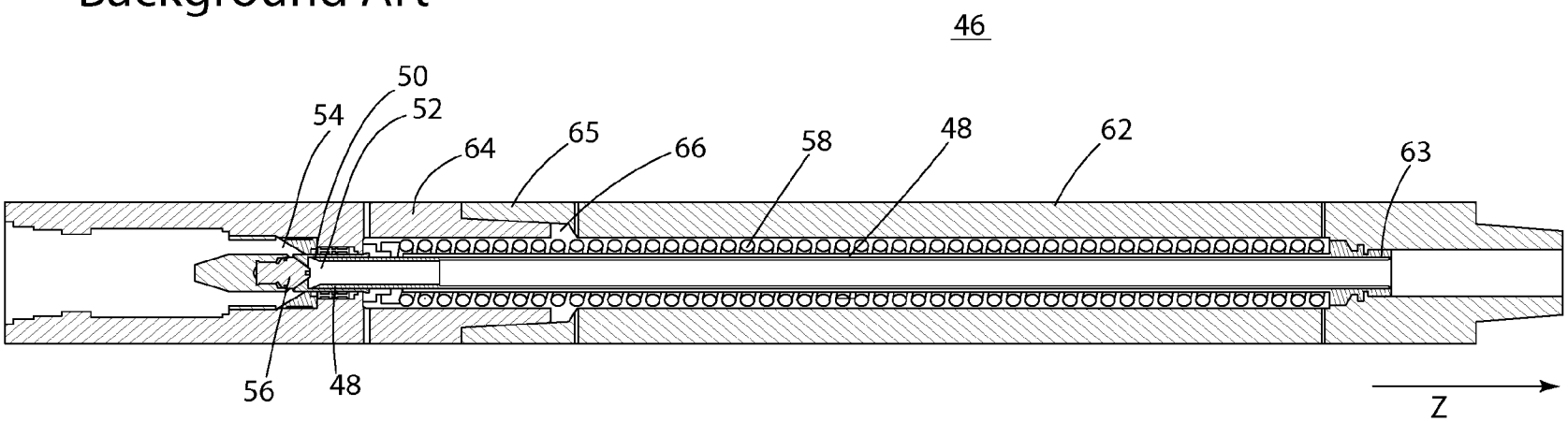
FIG. 3 Background Art
FIG. 3 is a schematic diagram of a conventional drill string valve mechanism.

A second end 76 of the drill string valve 70 is configured to have a lower cap 78. Cavity 79 should be understood as extending from the first end 74 to the second end 76. Cavity 79 includes plural chambers, as will be discussed later. A compensating piston 120 seals the cavity 79 from a mud 60 existent in the casing 44. A fluid 80 may flow through a conduit 81 of the drill string valve 70. The conduit 81 extends inside the cavity 79, from an upper flow nozzle 82 to a lower flow nozzle 84. In operation, the drill string valve 70 of this embodiment may be positioned vertically or substantially vertically and it has the first end 74 displaced above the second end 76, such that mud from the vessel enters, in this order, first end 74, upper flow nozzle 82, conduit 81, lower cap 78, and lower flow nozzle 84. It is noted that the drill string valve 70 is part of the drill string 24 (see FIG. 2), thus being provided inside casing 44.

According to an exemplary embodiment, a body of the drill string valve 70 may include three portions, first portion 86A, second portion 86B, and third portion 86C. The first two portions 86A and 86B may be connected together via a valve body 92 and the second portion 86B may be connected to the third portion 86C via a spring load cartridge 110.

FIG. 4 also shows a biasing cartridge 90 disposed inside the cavity 79 and configured to apply a first force on the sliding valve 50 such that the sliding valve 50 contacts the cone seal 56. The cone seal 56 may be replaced with a seal having another shape. A threaded stop 100 is provided inside cavity 79, between the biasing cartridge 90 and the second end 76. The threaded stop 100 is configured, as will be discussed later, to apply a second force on the biasing cartridge 90.

Figure 5:
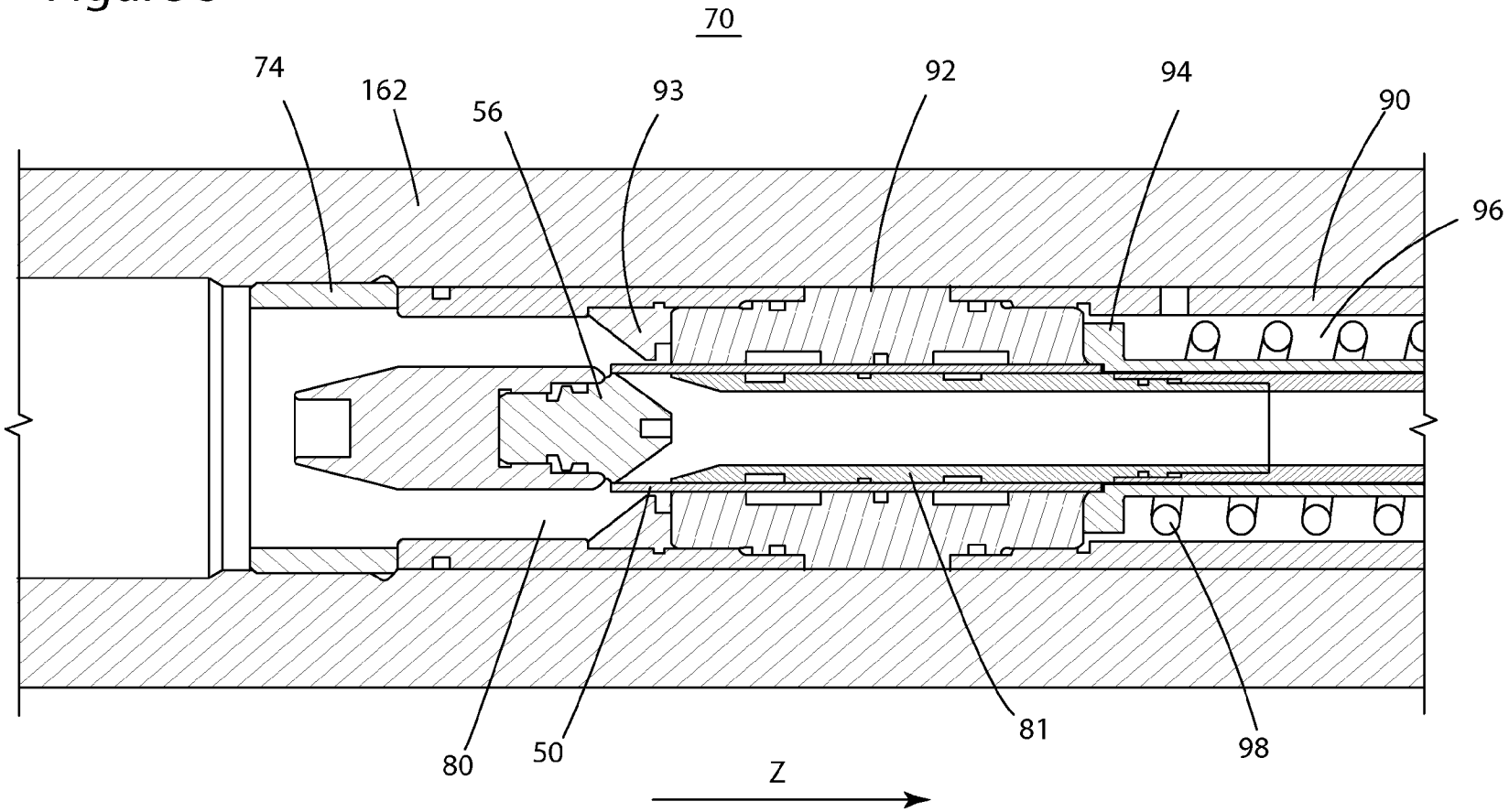
FIG. 5 is a more detailed view of a top portion of the drill string valve of FIG. 4 according to an exemplary embodiment.

Sliding valve 50 is configured to slide to and from cone seal 56, along a Z direction, as shown in FIG. 5. Sliding valve 50 is activated by actuator 94, which is configured to move inside a biasing chamber 96. Actuator 94 extends from the biasing chamber 96, via the valve body 92 towards the cone seal 56 so that a flow diverter 93 may extend in parallel with sliding valve 50. Flow diverter 93 may direct the flow of fluid 80, when under a pressure larger than a pressure created by the biasing cartridge 90, to push back actuator 94 and open the sliding valve 50. One or more wave springs 98 are also provided in the biasing chamber 96 for providing the first force on the actuator 94. One end of the biasing chamber 96 is bordered by a valve body 92 and the other end of the biasing chamber 96 is bordered by a spring spacer 99, as shown in FIG. 4. The drill string valve 70 may be included inside a collar 162 (see FIG. 4).

Figure 6:
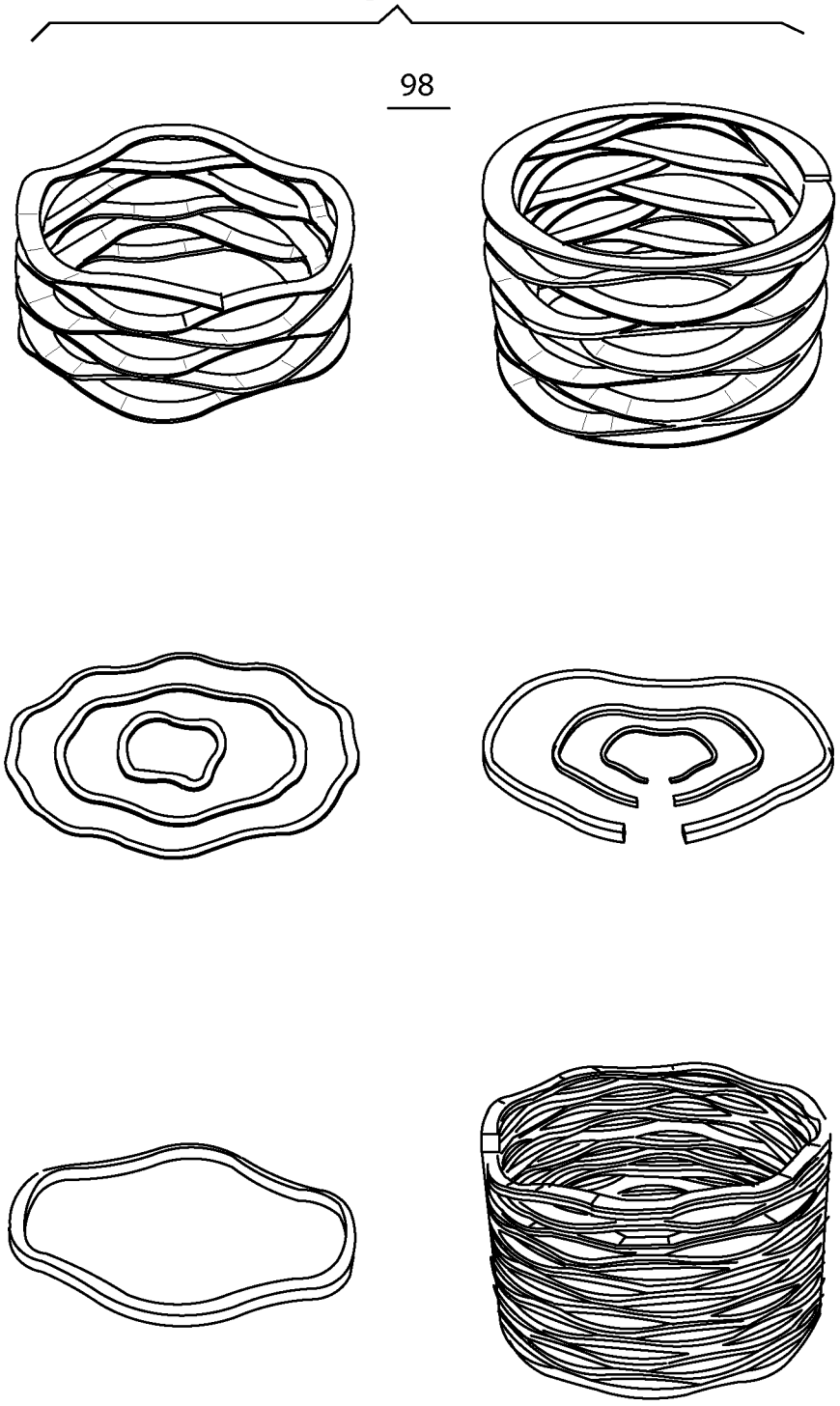
FIG. 6 is a schematic diagram of a wave spring.

In one exemplary embodiment, the wave spring 98 is not a coil spring but rather has one or more of the shapes shown in FIG. 6. Thus, according to an exemplary embodiment, the biasing cartridge 90 includes actuator 94, biasing chamber 96, and wave spring 98. Optionally, the biasing cartridge 90 may include a fluid inside the biasing chamber 96, for example, oil. For confining the fluid inside the biasing chamber 96, appropriate seals are provided at the ends of the biasing chamber 96 for preventing fluid leaks.

When deployed subsea, the sliding valve 50 of the drill string valve 70 is biased by the actuator 94 to actively engage the cone seal 56, thus sealing the conduit 81. The bias applied by the actuator 94 to the sliding valve 50 is a result of the compression of the wave spring 98. As will be discussed next, the wave spring 98 is initially deployed uncompressed inside the drill string valve 70, in order to avoid possible hazardous conditions. An advantage of the wave spring 98 is its reduced length in comparison to a conventional coil spring for generating a same spring force.

The threaded stop 100 configured to load the biasing cartridge 90 is discussed next with regard to FIG. 7. Spring spacer 99 separates the biasing cartridge 90 from the threaded stop 100.

According to an exemplary embodiment, the spring load cartridge 110 includes a hydraulic piston 102 and a threaded stop 100. A port 106 into loading chamber 108 provides access to pump hydraulic fluid into the loading chamber 108 to actuate hydraulic piston 102. Thus, hydraulic piston 102 moves from right to left in FIG. 7, in order to load the wave spring 98. More specifically, the hydraulic piston 102 contacts spring spacer 99 and presses the spring spacer 99 against wave spring 98, compressing the wave spring 98. In this way, the wave spring 98 may be loaded to a desired predetermined pressure without posing any danger to the safety of the operating personnel as the wave spring 98 is entirely contained inside the biasing chamber 96. A pressure sensor (not shown) may be included with the hydraulic pump so that a hydraulic fluid pressure in the loading chamber 108 may be correlated to a desired force generated by the wave spring 98 (i.e., a first force). Thus, the applied pressure may be stopped when the wave spring 98 has achieved the desired spring force. A force corresponding to the applied pressure is considered to be a second force.

Once the desired first force in the wave spring 98 is achieved, the hydraulic pressure applied to the loading chamber 108 is maintained constant and the threaded stop 100 is advanced toward the spring until the threaded stop 100 picks up the load of the wave spring 98, i.e., the threaded stop 100 fixes the spring spacer 99. At this point, the applied hydraulic pressure may be released from the loading chamber 108. Port 106 may be connected to a pump that pumps, for example, oil for activating the hydraulic piston 102. Other mechanism for hydraulic piston 102 may be used as would be appreciated by those skilled in the art.

The spring load cartridge 110 defines the border for loading chamber 108 and also provides a mating thread to the threaded stop 100. Once the spring load bias has been set, the lower section 86C is assembled, and the tool is ready to be installed in its collar.

According to an exemplary embodiment, the spring load cartridge 110 breaks the continuity of the external tubes 86B and 86C that constitute the outside wall of the drill string valve 70. In other words, the outside wall of the drill string valve may be made up of plural tubes. For example, the embodiment shown in FIG. 4 shows three different tubes 86A, 86B and 86C making up the external wall of the drill string valve 70. More or less tube components may be used depending on the units to be distributed inside the drill string valve 70.

Figure 7:
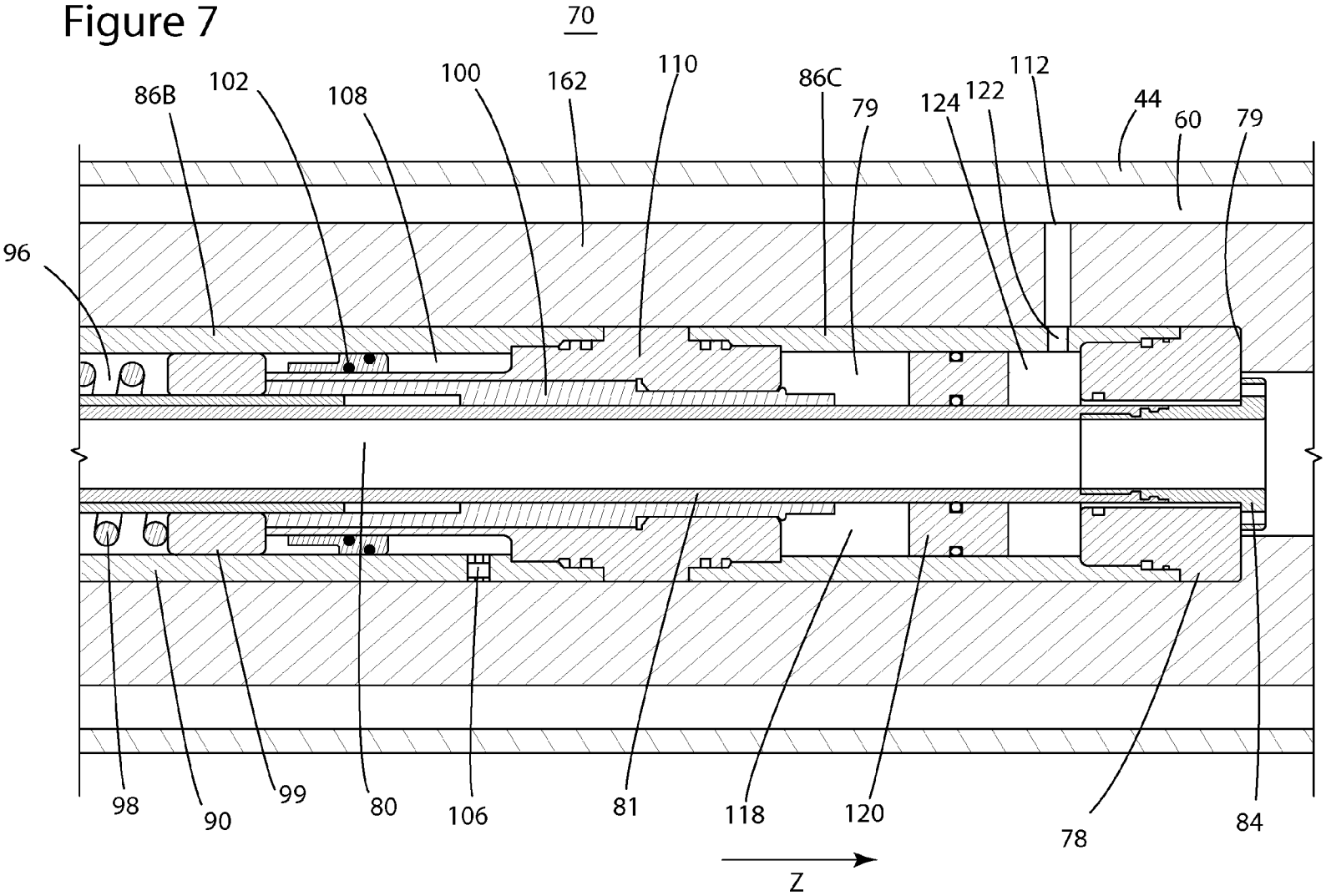
FIG. 7 is a more detailed view of a lower portion of the drill string valve of FIG. 4 according to an exemplary embodiment.

Still with regard to FIG. 7, a compensating piston 120 may be provided, according to an exemplary embodiment, inside a compensating chamber 118, between the spring load cartridge 110 and the lower cap 78. Although FIG. 7 shows both reference signs 79 and 118 pointing to the same chamber, as already discussed above, cavity 79 includes plural chambers, among which, the compensating chamber 118. In other words, cavity 79 extends along the entire drill string valve 70 and includes, at least biasing chamber 96, loading chamber 108 and compensating chamber 118.

Compensating chamber 118 communicates via a port 122 with an annulus space around the drill string valve 70 for providing annulus pressure 112 inside a chamber 124 of the compensating chamber 118, between the compensating piston 120 and the lower cap 78. In this way, the borehole fluids are separated from the clean oil present in the biasing chamber 96 and part of the loading chamber 108.

The next paragraphs summarize some of the features and/or advantages of the exemplary embodiments discussed above. While an exemplary embodiment may include one or more of these features/advantages, there are exemplary embodiments that include none of these features/advantages. The drill string valve body assembly has a constant outer diameter that enables horizontal or vertical insertion into the bore of the drill string valve collar.

The drill string valve collar is simple in design with a long counter bore terminating at a shoulder near the bottom and an internal thread near a top for a lock ring. The overall length may be short, for example, 13 ft (4 m). The body may be inserted in the collar and may land on a shoulder at the bottom of the valve. In one application there is no fixed orientation. The drill string valve may be retained and locked in place at the upper end with a threaded lock ring 74 (see FIG. 5). The modular drill string valve body provides for quick turnaround after tripping out. A replacement drill string valve body can quickly be swapped out with the returning body, or if loaded into a standby collar, swapped out with the returning collar. This feature will eliminate the risk of injury during assembly, streamline assembly, and provide accuracy and repeatability of spring settings.

The spring is installed in the drill string valve body at its free length (no spring load). A mechanism (loading mechanism) to load the spring is installed below the spring package. The mechanism to load the spring is integral to the drill string valve body, not an auxiliary tool. The remainder of the drill string valve body is assembled after the spring force is set.

The type of spring used for the drill string valve has an effective free length that is shorter than the free length of a coil spring, for example, half the free length of a coil spring with the same spring rate. This feature reduces system friction. The spring package, interior dynamic seals, and bearings are immersed in a pressure balanced oil system. The pressure balance is achieved with a port through the collar wall that taps onto the well bore annulus. A mating port in the lower cap of the drill string valve body channels the annulus pressure to a compensating piston separating the borehole fluids from the clean oil system.

According to another exemplary embodiment, various analytical tools, for example, sensors, may be provided inside the drill string valve. Such tools may include pressure sensors, load cell sensors, temperature sensors and sensors for determining a position of the sliding valve 50. This feature would optimize valve operation. As this type of valve opens very quickly, there is desired for the valve to open in a slower, controlled fashion to reduce the effect of pressure shocks on the well formation. Thus, the sensors discussed above may help monitor and control the drill string valve. According to an exemplary embodiment, a processor with memory capabilities may be deployed inside the drill string valve for collecting and processing the data from the above discussed sensors or others known in the art. Such capability may offer extended control of the drill string valve.

Analytical tools provide the ability to optimize a given spring for use over a wide range of operation. This will lessen the frequency of exchanging spring hardware during the course of drilling program. Simulation software provides the capability to input changing operating conditions and to determine the effects of them in a time sequence. This capability is desired for custom spring design.

This feature includes the addition of downhole diagnostic instrumentation, for example, a data acquisition system may be packaged in an electronics pressure vessel upstream of the drill string valve body. The time synchronized data acquisition may record pressures, acceleration, spring load, valve position, and temperature data. Pressure transducers ports may be positioned upstream and downstream of the valve seat for measuring local static and dynamic pressures.

A time synchronized data acquisition unit may be packaged with a linear measurement transducer to record valve position. Data ports may be built into the drill string valve body for data download, real-time data monitoring during lab testing, flow loop testing, and pre-check diagnostics prior to deployment. Hydraulic access ports may also be built into the drill string valve body for lab testing, flow loop testing and pre-deployment checks.

Figure 8:
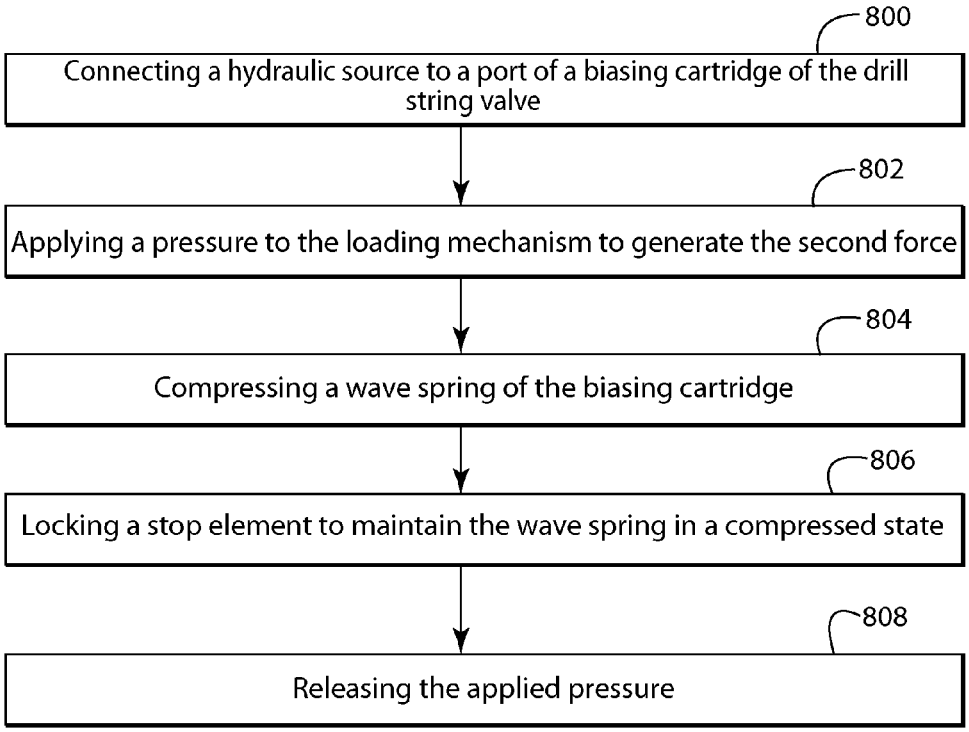
FIG. 8 is a flow chart illustrating steps of a method for activating a drill string valve according to an exemplary embodiment.

According to an exemplary embodiment, steps of a method for activating the drill string valve 70 are illustrated in FIG. 8. The method includes a step 800 of connecting a hydraulic source to a port of a biasing cartridge of the drill string valve. The drill string valve includes (i) an elongated housing 86*b* having an inside cavity, the housing extending along an axis and having a substantially constant outer diameter, and (ii) a hydraulic piston 102 disposed within the inside cavity. The method also includes a step 802 of applying a pressure to the loading mechanism to generate the second force, a step 804 of compressing a wave spring of the biasing cartridge, a step 806 of locking a stop element to maintain the wave spring in a compressed state, and a step 808 of releasing the applied pressure.

According to another exemplary embodiment, a drill string valve 160, different from the drill string valve 70 or other valves discussed above is now discussed with regard to FIG. 9. The drill string valve of FIG. 9 has one or more of the following advantages over a conventional valve. The conventional valve opens when the mud pumps are on and closes when the mud pumps are off. A throttling feature based on an amount of openness of the drill string valve provides smooth flow transitions. The conventional design uses a coil spring to close the valve. The spring force at closing was designed to support the weight of the mud column. The force was primarily based on the mud weight and depth of the water as well as other well planning parameters. Since the mud weight, flow rate and water depth combinations constitute a 3-D matrix, a host of spring package load settings are required.

Figure 9:
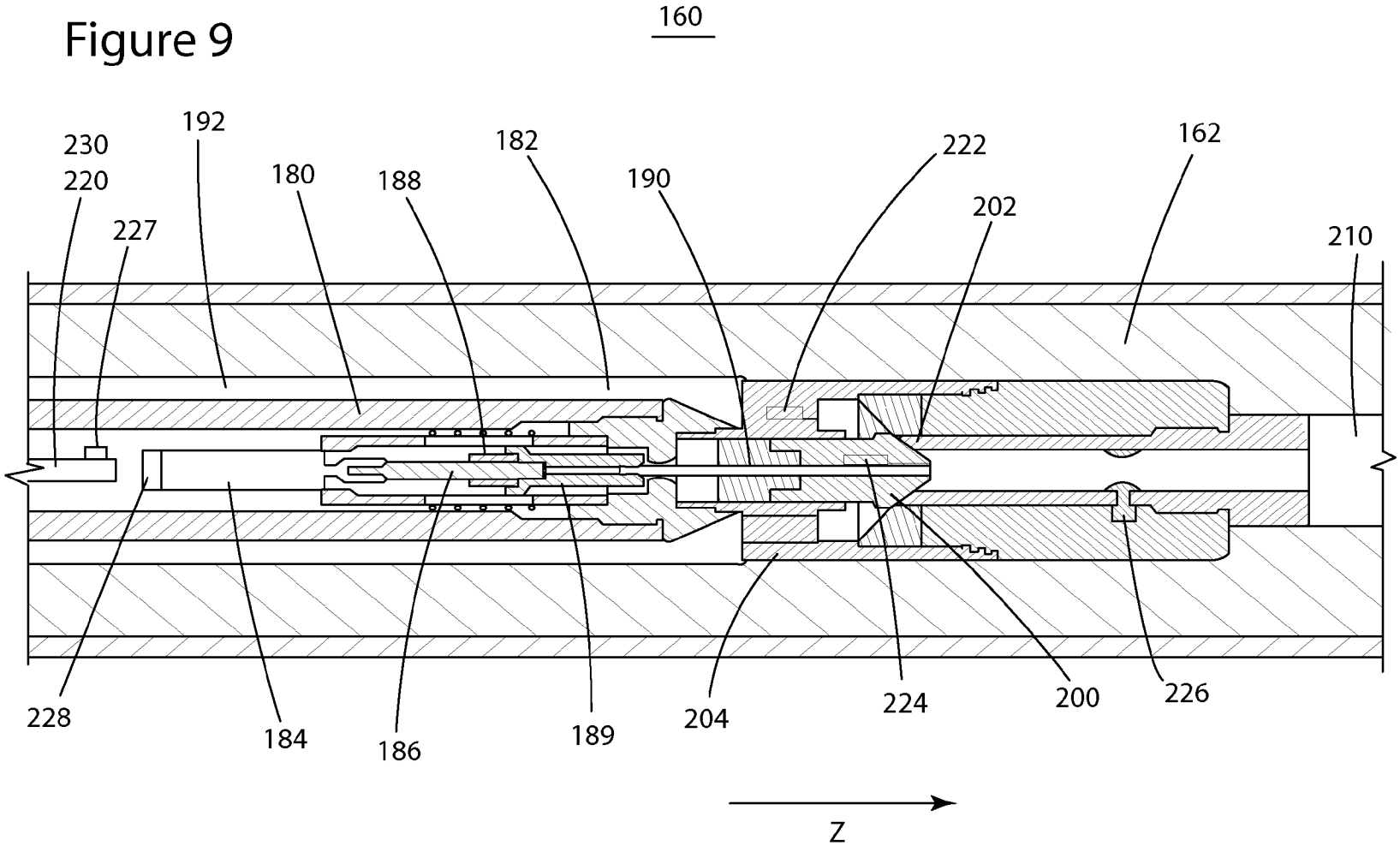
FIG. 9 is a schematic diagram of another novel drill string valve according to an exemplary embodiment.

The novel drill string valve shown in FIG. 9 replaces, among others, the spring with a motor-driven valve actuation system having feed-back control. This new valve eliminates pressure bias on the poppet valve so that an actuation rod does not receive a large axial load. An electronic package that controls the opening and closing of the valve may include a microprocessor control with data acquisition. The instrumented drill string valve may include pressure transducers to monitor absolute pressure and differential pressures across the valve opening and an encoder for monitoring poppet position. A lithium battery may provide the necessary power for the electronic package. The drill string valve module may be mounted in a 8 ft (2.5 m) pony collar.

According to an exemplary embodiment, the drill string valve 160 includes a collar 162 inside of which various components are provided. For example, a motor module 180 is provided in contact with a spider 204. The spider 204 seals a motor chamber 182, in which the motor module is fixed. FIG. 9 shows that the motor module 180 includes a motor 184 that is attached to and configured to rotate a ball screw 186. The ball screw 186 rotates in a ball screw nut 188. The ball screw nut 188 connects to a guide sleeve 189 that is fixed to an actuation rod 190 for activating a poppet 200. Motor 184, ball screw 186 and ball screw nut 188 may be distributed inside a pressure vessel 192, to prevent any liquid entering the motor module 180. The motor module 180 may be controlled by a micro-processor 230 with a data acquisition board 220. A power source for the electronics, sensors and motor may be a battery or a hydraulic source.

Actuation of the motor 184 determines the extension or retraction of the ball screw 186 and actuation rod 190, which determine the movement of poppet 200 towards and away from poppet seat 202. When the poppet 200 is in contact with the poppet seat 202, no fluid (or an insignificant amount) passes through the drill string valve 160. The pressure vessel 192 that accommodates the motor module 180 may be connected to the spider 204, which is configured to accommodate the poppet 200. As would be recognized by one skilled in the art, appropriate seals are formed around various elements discussed above for preventing fluid entering the motor module.

A pressure inside the drill string valve 160, may be monitored by pressure sensors 222 and 224. A position of the poppet 200 may be monitored with a position sensor 228. Such a position sensor 228 and accompanying mechanism may be a LVDT, as described in Young et al., Position Instrumented Blowout Preventer, U.S. Pat. No. 5,320,325, Young et al., Position Instrumented Blowout Preventer, U.S. Pat. No. 5,407,172, and Judge et al., RAM BOP Position Sensor, U.S. Patent Application Publication No. 2008/0196888, the entire contents of which are incorporated herein by reference.

Based on the data provided by the pressure sensors 222 and 224, and optionally by flow meter 226 and/or position sensor 228, the microprocessor 230 may determine when to close or open poppet 200. The microprocessor 230 may be provided in a custom made chamber in the body of the drill string valve 160. According to an exemplary embodiment, the microprocessor 230 is configured to adjust the closing of the drill string valve 160 depending whether poppet 200 is completely closed, poppet 200 is starting to open or close, and/or poppet 200 is open. It is noted that a pressure in the annulus (i.e., outside the motor module 180) is larger when the drill string valve is closed than when the drill string valve is opened. Thus, based on the pressure measurements and/or position of the poppet, the amount of opening of the poppet 200 may be controlled, thus achieving a feed-back controlled drill string valve.

Figure 10:
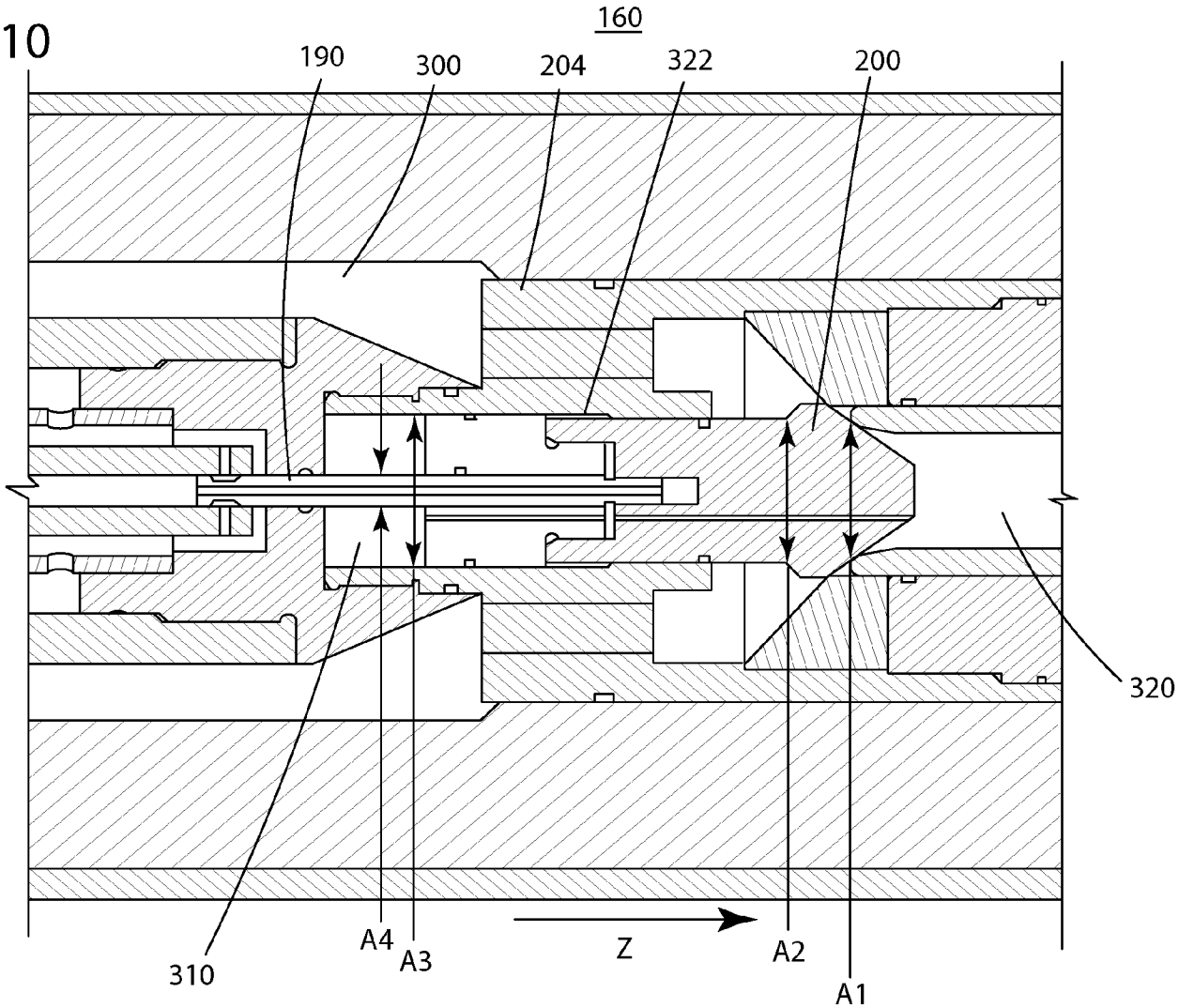
FIG. 10 is a schematic diagram of the drill string valve of FIG. 9 that illustrates various pressures present in the valve according to an exemplary embodiment.

With regard to FIG. 10, various pressures inside the drill string valve are illustrated. A pressure at location 300 in the pipe may be different from a pressure at location 310 around actuation rod 190, which is equalized to a pressure at location 320. The annular cavity between spider 204 and poppet 200 is filled with a gas 322 at low pressure. The changes in pressure of gas 322 during deployment are insignificant compared to pressure at location 300 and pressure at location 320. This balanced pressure on both sides of poppet 200 ensures that motor 184 needs to apply a small force for the actuation of rod 190, for displacing poppet 200. The pressure at location 310 around actuation rod 190 is made equal to annulus pressure 320 by selecting diameters A1, A2, A3 and A4. Thus, minimal motor torque requirements are needed for a proper functioning of the poppet. The drill string valve 160 works for all depths and mud weights without having to reconfigure or adjust any mechanisms.

Next, the operation of the drill string valve is discussed. The drill string valve is a pressure regulating check valve that uses a flow for compensation. The valve has two modes of operation, which are drilling mode with pumps on and non-drilling mode with pumps off. During the drilling mode the drill string valve becomes a flow compensated check valve. During the non-drilling mode, the drill string valve prevents the mud column above the valve from free falling when the mud pumps are turned off.

The drill string valve 70 employs a spring to control the valve opening. According to an exemplary embodiment, the design of the valve spring is dependent on the spring load, the spring rate, the flow rate, the mud weight, the back pressure of the bit nozzles, and the flow losses in the well from pipe friction, casing friction, and any downhole tools in the drill string. Because of the array of operating variables the throttling performance of a spring actuated valve is indeterminate.

The drill string valve 160 may use a microprocessor and sensor data from on board sensors to control valve position. The drilling mode is determined by measuring the broad band acceleration of the drill string valve. There is a distinctive change in the broad band when the mud pumps are turned off and on. The microprocessor may read acceleration, mud flow rate, valve position, and differential pressures. Before the tool is run, inputs for control and look-up tables for valve opening vs. time are downloaded via a communication device, for example, a computer. The look-up tables are constructed to meet the requirements of the well plan and may vary from application to application. When the microprocessor senses there is broad band response from the accelerometer, the microprocessor begins modulating the valve and controlling the valve opening based at least in part on information in the look-up table.

Returning to FIG. 9, a flow meter 226 and the valve position sensor 228 are configured to provide data to the microprocessor 230 via data acquisition 220. The micro-processor software algorithm is based on a user-defined relationship between flow rate and valve position (flow rate vs. position). The processor compares the actual valve position with the desired valve position based on real-time flow rate. The processor sends a command to the motor controller board 227 to have the motor 184 reposition the poppet 200. According to an exemplary embodiment, a look-up table may be stored in a memory (not shown) connected to the micro-processor 230 and includes a flow rate threshold so that for any measured flow rate above the threshold, the micro-processor 230 is configured to close the seal element to suppress the fluid flow.

According to an exemplary embodiment, the seal element and the seat of the above discussed embodiments are configured, when closed, to withstand pressures of 30,000 psi.

Figure 11:
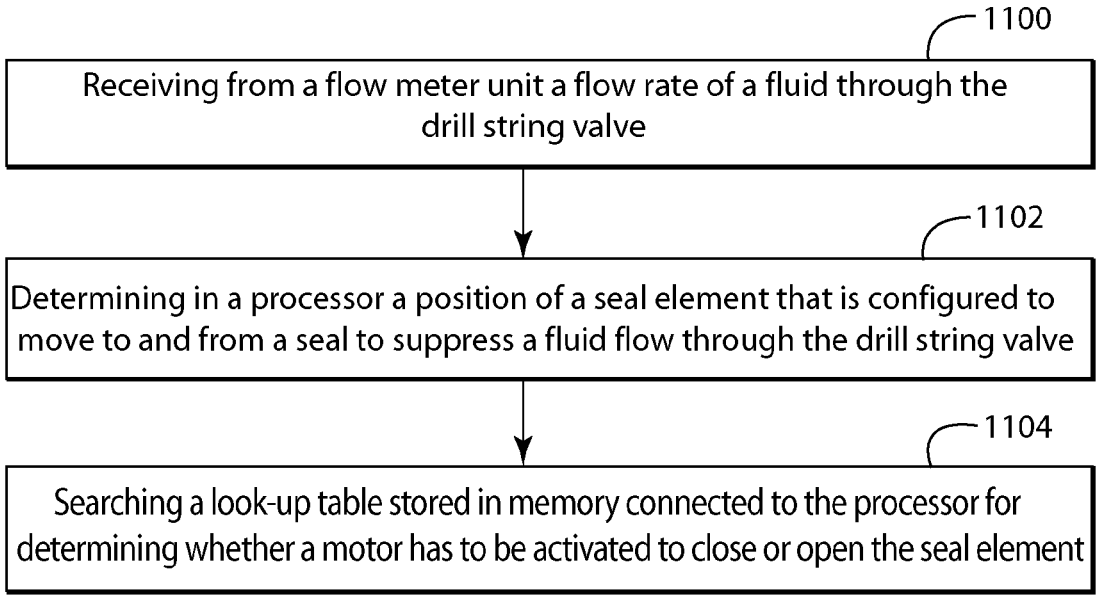
FIG. 11 is a flow chart illustrating steps of a method for controlling a drill string valve according to an exemplary embodiment.

According to an exemplary embodiment shown in FIG. 11, there is a method for controlling a drill string valve. The method includes a step 1100 of receiving from a flow meter unit a flow rate of a fluid through the drill string valve, a step 1102 of determining in a processor a position of a seal element that is configured to move to and from a seat to suppress a fluid flow through the drill string valve, and a step 1104 of searching a look-up table stored in memory connected to the processor for determining whether a motor has to be activated to close or open the seal element.

Figure 12:
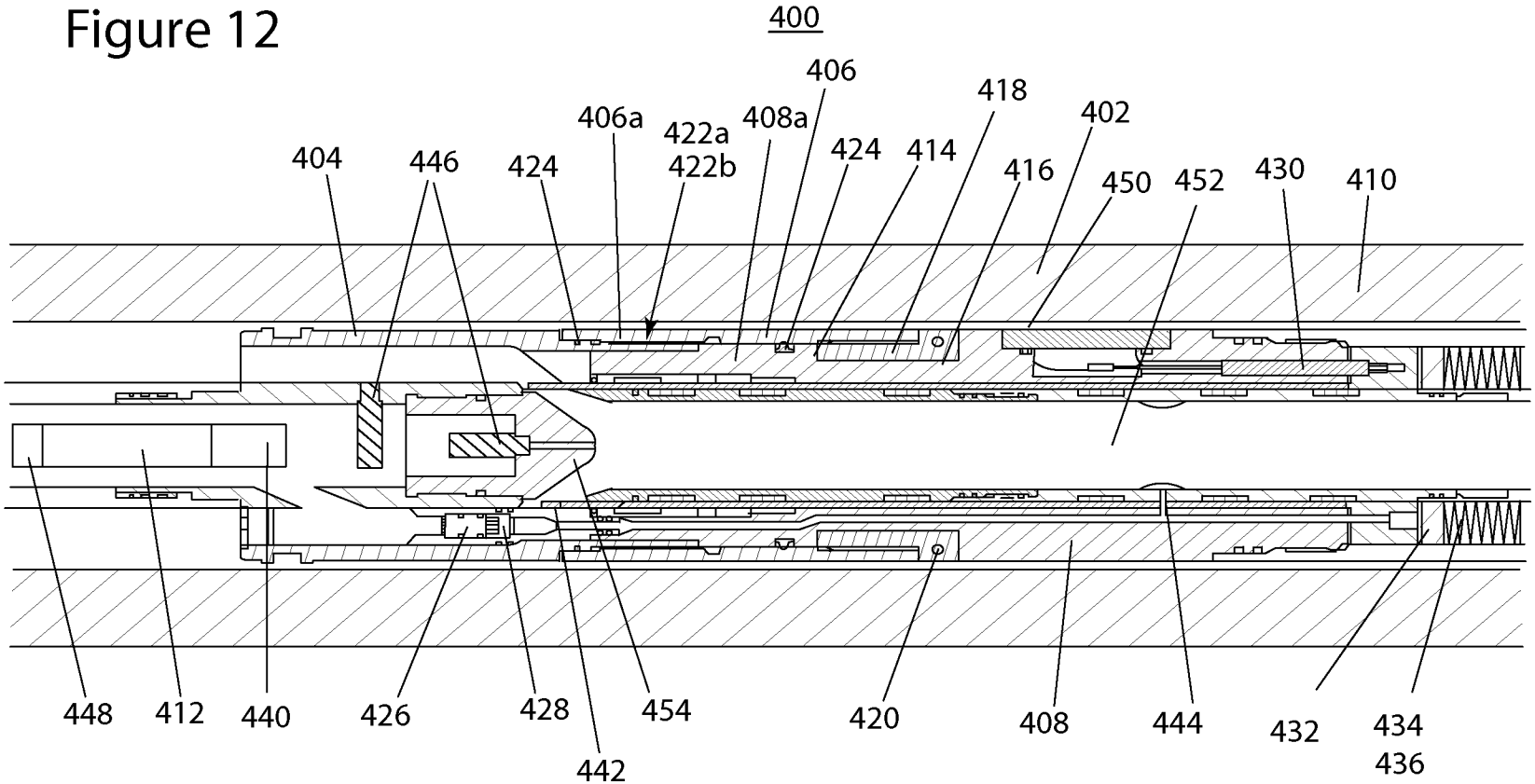
FIG. 12 is a schematic diagram of a drill string valve assembly according to an exemplary embodiment.

According to an exemplary embodiment illustrated in FIG. 12, a drill string valve assembly 400 includes a valve module 402. Various plural parts need to be assembled for providing the valve module 402 inside the drill string valve assembly 400. The drill string valve assembly 400 includes a first portion 404, a second portion 406 and a third portion 408. The third portion 408 is fixed to a drill collar 410 of the drill string valve assembly 400. The first and second portions 404 and 406 are configured to be attached to the third portion 408 as discussed next.

The first portion 404 is configured to house the electronics 412 associated with the valve module 402. The third portion 408 has a distal end 408*a* configured to be completely covered by the second portion 406 and partially covered by the first portion 404. The distal end 408*a* has a shoulder 414 which borders a groove 416 formed in the third portion 408. An extension 418 of the second portion 406 is configured to fit inside the groove 416. In one application, the extension 418 is configured to be circular. In order to fit the extension 418 around the third portion 408, the extension 418 may be formed in two pieces, e.g., two halves of a cylinder. Thus, the two halves are placed around the third portion 408 and attached to each other by, e.g., two or more screws 420. Once provided around the third portion 408, the second portion 406 may rotate relative to the third portion 408.

The second portion 406 has a distal region 406*a* provided with a thread 422*a* configured to engage a corresponding threaded region 422*b* of the first portion 404. Thus, after the second portion 406 is rotatably attached to the third portion 408, the first portion 404 is brought into contact with the second portion 406 and the second portion 406 is rotated relative to the first portion 404 until the two portions are tight together. Appropriate seals 424 are provided between the first and second portions to prevent a leak between the annular fluid 450 and the internal pipe fluid 452. The engagement of first portion 404 and the third portion 408 are keyed in that their radial orientations are aligned to each other. The engagement of first portion 404 and the third portion 408 have mating diameters with a light press-fit that provides a reliable seal between the cone seal 454 and sliding valve 442.

FIG. 12 also shows male and female electric connections 426 and 428 that connect various electrical sensors or devices from the third portion 408 to the first portion 404. The male connection 426 is electrically connected to electronics 412 while the female connection 428 is electrically connected to a displacement sensor 430 and/or a load transducer 432. The displacement sensor 430 is configured to determine a linear displacement of springs 434 and 436 along axis Z and or a linear displacement of the sliding valve 442. The displacement sensor 430 may be any available displacement sensor. The load transducer 432 is configured to measure a force (load) applied or formed inside the springs 434 and 436.

By knowing the force in the springs 434 and 436 and/or the displacement of these springs, a micro-processor 440 provided, e.g., in the electronics 412, may determine when to close or open the valve 442 for allowing or interrupting a flow through the valve module 402. The processor 440 may be configured to receive other data, e.g., flow rate from a flow meter 444 and/or pressure data from pressure sensors 446. As discussed above, the micro-processor software algorithm may be based on a user-defined relationship between some or all of the above measured quantities and valve position. The processor compares the actual valve position with the desired valve position based on this data. The processor sends a command to the motor controller board 227 (discussed above with regard to FIG. 9) to have the motor 184 reposition the poppet 200. According to an exemplary embodiment, a look-up table may be stored in a memory 448 connected to the micro-processor 440 and includes some threshold values so that for any measured quantity above the threshold, the micro-processor 440 is configured to close the seal element to suppress the fluid flow.

Figure 13:
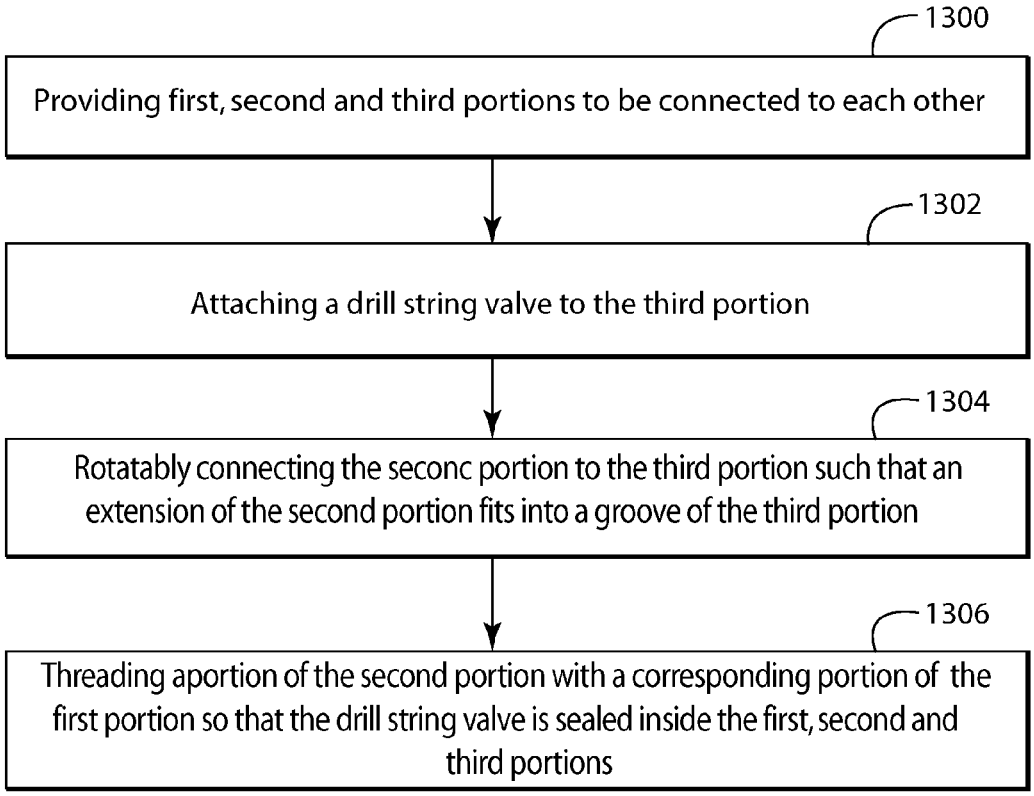
FIG. 13 is a flow chart illustrating a method for manufacturing the drill string valve assembly according to an exemplary embodiment.

According to an exemplary embodiment illustrated in FIG. 13, there is a method for assembling a drill string valve assembly. The method includes a step 1300 of providing first (404), second (406) and third (408) portions to be connected to each other; a step 1302 of attaching a drill string valve to the third portion (408); a step 1304 of rotatably connecting the second portion (406) to the third portion (408) such that an extension (418) of the second portion (406) fits into a groove (416) of the third portion; and a step 1306 of threading a portion (422*a*) of the second portion (406) with a corresponding portion (422*b*) of the first portion (404) so that the drill string valve (402) is sealed inside the first, second and third portions (404, 406, 408).

The disclosed exemplary embodiments provide a system and a method for closing and opening a valve through which a fluid may flow. The exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other example are intended to be within the scope of the claims.

What is claimed is:

1. A drill string valve, comprising:

a tubular housing having an axis and threaded upper and lower ends for connection into a drill string;

an axially movable valve element mounted in the housing, the valve element having an open position that allows drilling fluid to flow through the housing into the drill string below the housing, and a closed position that blocks the flow of drilling fluid through the housing;

a spring in cooperative engagement with the valve element for urging the valve element toward the closed position, the spring being located within a spring chamber in the housing that is filled with a liquid that differs from the drilling fluid;

a separating piston movably carried in the housing within a drilling fluid chamber that is in fluid communication with the drilling fluid that has been pumped down the drill string, the separating piston separating the drilling fluid in the drilling fluid chamber from the liquid in the spring chamber;

a spring chamber piston that has one side in contact with the liquid in the spring chamber, the spring chamber piston being cooperatively engaged with the valve element for moving the valve element in response to movement of the spring chamber piston; and wherein the separating piston is axially movable relative to the spring chamber piston.

2. The drill string valve according to claim 1, further comprising:

a conduit extending through the spring chamber through which the drilling fluid flows while the valve element is in the open position; and wherein the spring encircles the conduit.

3. The drill string valve according to claim 1, wherein the liquid in the spring chamber comprises an oil.

4. The drill string valve according to claim 1, further comprising:

a conduit extending through the spring chamber through which the drilling fluid flows while the valve element is in the open position;

wherein the separating piston has a bore through which the conduit sealingly extends; and the separating piston is movable relative to the conduit in response to changes in the pressure of the drilling fluid in the drilling fluid chamber.

5. The drill string valve according to claim 1, wherein:

movement of the separating piston occurs in response to changes in the pressure of the drilling fluid in the drilling fluid chamber; and movement of the separating piston causes changes in pressure of the liquid in the spring chamber.

6. The drill string valve according to claim 1, wherein:

the separating piston is located below the spring chamber piston.

7. A drill string valve, comprising:

a tubular housing having an axis and threaded upper and lower ends for connection into a drill string;

an axially extending conduit within the housing for the passage of the drilling fluid pumped down the drill string into the portion of the drill string located below the housing;

an axially movable valve element mounted in the housing, the valve element having an open position that allows drilling fluid to flow through the conduit and a closed position that blocks the flow of drilling fluid through the conduit;

an annular separating piston movably carried in the housing and encircling the conduit, defining a drilling fluid chamber on one side of the separating piston and a spring chamber on another side of the separating piston, the spring chamber containing a liquid, the drilling fluid chamber being in fluid communication with drilling fluid that has been pumped down the drill string, the separating piston being movable in the housing in response to a difference in pressure between the liquid in the spring chamber and the drilling fluid in the drilling fluid chamber;

a spring located in the spring chamber and in cooperative engagement with the valve element, the spring biasing the valve element to the closed position, the spring being immersed in the liquid;

a spring chamber piston movably carried in the housing that has one side in contact with the liquid in the spring chamber, the spring chamber piston being cooperatively engaged with the valve element for moving the valve element in response to movement of the spring chamber piston; and wherein the separating piston is axially movable relative to the spring chamber piston.

8. The drill string valve according to claim 7, wherein the separating piston is located below the spring chamber piston.

9. The drill string valve according to claim 7, wherein the separating piston is movable relative to the conduit.

10. The drill string valve according to claim 7, wherein upward movement of the spring chamber piston results in the valve element moving toward the closed position.

11. The drill string valve according to claim 7, wherein the spring chamber piston is movable in response to the pressure of the liquid in the spring chamber.

12. The drill string valve according to claim 7, wherein the liquid in the spring chamber comprises an oil.

13. The drill string valve according to claim 7, wherein the spring encircles the conduit.

14. A well drilling operation comprising downward pumping drilling fluid through a drill string into the well, discharging the drilling fluid out a drill bit and returning the drilling fluid up an annulus in the well surrounding the drill string, a method of preventing the drilling fluid from continuing to flow downward in the drill string in the event the downward pumping ceases, comprising:

(a) mounting in the drill string a drill string valve having a movable valve element with a closed position and an open position, and a spring that exerts a bias force to the valve element toward the closed position;

(b) locating the spring in the housing within a spring chamber that is filled with a liquid that differs from the drilling fluid;

(c) with a separating piston, separating the liquid in the spring chamber from drilling fluid in a drilling fluid chamber;

(d) lowering the drill string into the well, pumping drilling fluid down the drill string and overcoming the bias of the spring with pressure of the drilling fluid being pumped, thereby opening the valve element and flowing the drilling fluid past the valve element;

(e) diverting some of the drilling fluid that has been pumped down the drill string to the drilling fluid chamber, which acts on the separating piston to cause the separating piston to move and change a pressure of the liquid in the spring chamber;

mounting a spring chamber piston in the housing with one side of the spring chamber piston in contact with the liquid in the spring chamber, the spring chamber piston being independently movable relative to the separating piston; wherein step (e) causes movement of the spring chamber piston; and movement of the spring chamber piston causes the valve element to move between the open and closed positions.

* * * * *